US006231460B1

(12) United States Patent
Higuchi et al.

(10) Patent No.: US 6,231,460 B1
(45) Date of Patent: May 15, 2001

(54) MULTILAYER STRUCTURE SOLID GOLF BALL

(75) Inventors: Hiroshi Higuchi; Yasushi Ichikawa; Hisashi Yamagishi, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/268,661

(22) Filed: Mar. 16, 1999

(30) Foreign Application Priority Data

Mar. 16, 1998 (JP) ..... 10-085029

(51) Int. Cl.[7] ..... A63B 37/04; A63B 37/06

(52) U.S. Cl. ..... 473/374; 473/351; 473/373; 473/375; 273/220

(58) Field of Search ..... 473/373, 374, 473/375, 351; 273/220

(56) References Cited

U.S. PATENT DOCUMENTS

| | | | | |
|---|---|---|---|---|
| 4,679,794 | | 7/1987 | Yamada et al. . | |
| 5,300,325 | | 4/1994 | Nealon et al. . | |
| 5,779,562 | * | 7/1998 | Melvin | 473/373 |
| 5,792,009 | * | 8/1998 | Maruko | 473/359 |
| 5,813,923 | * | 9/1998 | Cavallaro | 473/373 |
| 5,816,943 | * | 10/1998 | Masutani | 473/365 |
| 5,820,485 | * | 10/1998 | Hwang | 473/361 |
| 5,856,388 | * | 1/1999 | Harris | 524/320 |
| 5,873,796 | * | 2/1999 | Cavallaro | 473/365 |
| 5,876,294 | * | 3/1999 | Yamagishi | 473/374 |
| 5,899,822 | * | 5/1999 | Yamagishi | 473/374 |
| 5,965,669 | * | 10/1999 | Cavallaro | 525/221 |
| 5,976,035 | * | 11/1999 | Umezawa | 473/364 |
| 6,056,842 | * | 5/2000 | Dalton | 156/243 |
| 6,106,415 | * | 8/2000 | Masutani | 473/374 |

FOREIGN PATENT DOCUMENTS

| | | |
|---|---|---|
| 1265596 | 3/1972 | (GB) . |
| 2316328 | 2/1998 | (GB) . |
| 2316878 | 3/1998 | (GB) . |
| 10-179795 | 7/1998 | (JP) . |

* cited by examiner

*Primary Examiner*—Gregory L. Huson
*Assistant Examiner*—Paul D. Kim
(74) *Attorney, Agent, or Firm*—Sughrue, Mion, Zinn, Macpeak & Seas, PLLC

(57) ABSTRACT

In a multilayer structure solid golf ball having a solid core, an intermediate layer, and a cover, the intermediate layer is formed mainly of a thermoplastic polyurethane elastomer, and the cover is formed mainly of an ionomer resin. An adhesive layer intervenes between the intermediate layer and the cover. The ball has improved rebound and spin properties.

14 Claims, 1 Drawing Sheet

MULTILAYER STRUCTURE SOLID GOLF BALL

BACKGROUND OF THE INVENTION

1. Field of the Invention

This invention relates to a multilayer structure solid golf ball comprising a solid core, an intermediate layer, and a cover. More particularly, it relates to a multilayer structure solid golf ball having improved rebound and spin properties.

2. Prior Art

Golf balls are generally classified into wound golf balls and solid golf balls. In general, wound golf balls have good spin properties and controllability and offer a pleasant feel when hit, but are inferior in flight distance to solid golf balls. Inversely, solid golf balls travel a longer distance, but are inferior in spin properties and feel.

In the past, the majority of solid golf balls were two-piece solid golf balls. Recently, multilayer structure solid golf balls including three-piece solid golf balls having a solid core enclosed with a cover via an intermediate layer are increasing in use. By selecting the material and gage of the intermediate layer and the cover or by constructing the intermediate layer and the cover from a plurality of layers, multilayer structure solid golf balls can be improved in the spin properties and feel, which are considered deficiencies in solid golf balls, while maintaining or even improving the excellent flight performance characteristic of solid golf balls. Then multilayer structure solid golf balls offer ease of control and a good feel when hit, both comparable to those of wound golf balls. For this reason, many professional golfers and top amateur players now use solid golf balls.

For such multilayer structure solid golf balls, however, there is still a desire to increase the resilience of the ball for further extended distance and to improve the spin properties.

SUMMARY OF THE INVENTION

Therefore, an object of the invention is to provide a multilayer structure solid golf ball having further improved rebound and spin properties.

According to the invention, there is provided a multilayer structure solid golf ball comprising a solid core, an intermediate layer on the core, and a cover enclosing the intermediate layer. The intermediate layer is formed mainly of a thermoplastic polyurethane elastomer. The cover is formed mainly of an ionomer resin. An adhesive layer intervenes between the intermediate layer and the cover. Since the adhesive intervening between the intermediate layer and the cover tightly joins the intermediate layer and the cover, the interface between the intermediate layer and the cover is made tough so that the ball is improved in rebound and spin properties.

BRIEF DESCRIPTION OF THE DRAWING

The only figure.

DETAILED DESCRIPTION OF THE INVENTION

Figure 1:
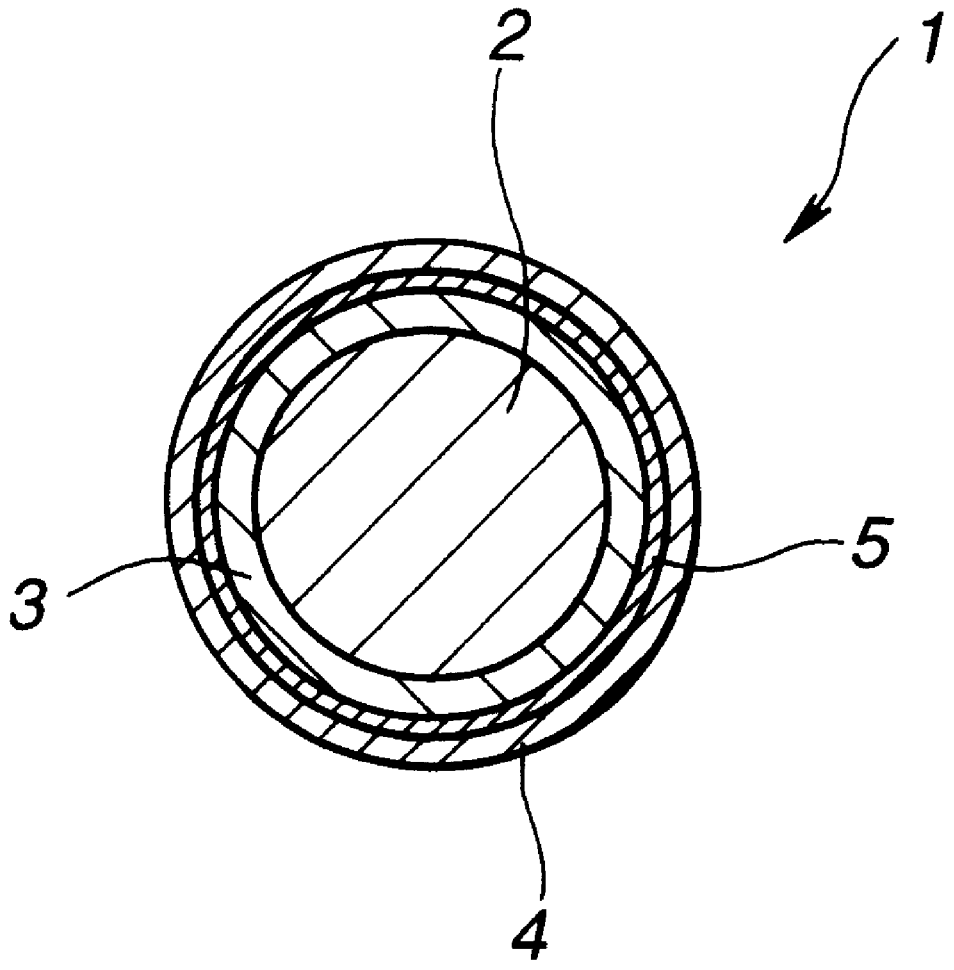
FIG. 1 is a cross-sectional view of a solid golf ball according to one embodiment of the invention.

Referring to FIG. 1, a multilayer structure solid golf ball 1 according to the invention is illustrated as comprising a solid core 2, an intermediate layer 3 on the core 2, and a cover 4 enclosing the intermediate layer 3. An adhesive layer 5 is located between the intermediate layer 3 and the cover 4. Differently stated, the cover 4 is adhesively joined to the intermediate layer 3.

The solid core may be formed of a rubber composition comprising a base rubber, co-crosslinking agent, peroxide, and other additives. The core is typically formed by molding the rubber composition under heat and pressure.

The base rubber may be natural and/or synthetic rubber commonly used in prior art solid golf balls although 1,4-polybutadiene containing at least 40%, especially at least 90% of cis-structure is preferable. Another rubber component such as natural rubber, polyisoprene rubber or styrene-butadiene rubber may be blended with the polybutadiene rubber if desired. For high resilience, the base rubber should preferably contain at least 90% by weight of 1,4-polybutadiene having at least 90% of cis-structure.

In conventional solid golf balls, zinc and magnesium salts of unsaturated fatty acids such as methacrylic acid and acrylic acid and esters such as trimethylpropane trimethacrylate are used as the co-crosslinking agent. These compounds may be used herein although zinc acrylate is preferred because it can impart high resilience. The co-crosslinking agent is preferably used in an amount of about 10 to 30 parts by weight per 100 parts by weight of the base rubber.

Various peroxides are useful although dicumyl peroxide or a mixture of dicumyl peroxide and 1,1-bis(t-butylperoxy)-3,3,5-trimethylcyclohexane is appropriate. The amount of the peroxide blended is preferably about 0.5 to 1 part by weight per 100 parts by weight of the base rubber.

In the rubber composition, zinc oxide or barium sulfate are blended if necessary for adjusting the specific gravity. Anti-oxidants and other additives are also blended therein if desired.

In preparing the solid core from the rubber composition, the above-mentioned components are kneaded in a conventional mixer such as a kneader, Banbury mixer or roll mill, placed in a mold, and molded under appropriate heat and pressure, preferably at 145 to 160° C.

Preferably, the solid core should have a hardness such that the core experiences a deflection of 1 to 10 mm, more preferably 2 to 8 mm, most preferably 3 to 5 mm under a load of 100 kg. The solid core preferably has a diameter of 26 to 40 mm, more preferably 32 to 38 mm, and most preferably 34 to 37 mm. Further preferably, the core at the surface has a Shore D hardness of 30 to 60, more preferably 35 to 55. The core preferably has a specific gravity of 0.98 to 1.3, more preferably 1.0 to 1.25. The core may have a weight of 21.4 to 40.5 grams, especially 26.0 to 39.45 grams.

Most often, the core is formed of a one-piece structure consisting of a single layer although it may be formed to a multilayer structure of two or more layers if desired.

In the golf ball of the invention, the intermediate layer is formed mainly of a thermoplastic polyurethane elastomer. The thermoplastic polyurethane elastomer has a molecular structure including soft segments of a high molecular weight polyol, hard segments constructed of a monomolecular chain extender, and a diisocyanate.

The high molecular weight polyol compound is not critical and may be any of polyester polyols, polyol polyols, copolyester polyols, polycarbonate polyols and polyether polyols. The polyester polyols include polycaprolactone glycol, poly(ethylene-1,4-adipate)glycol, and poly(butylene-1,4-adipate)glycol. Typical of the copolyester polyols is poly(diethylene glycol adipate)glycol. One exemplary polycarbonate polyol is hexane diol -1,6-carbonate glycol. Polyoxytetramethylene glycol is typical of the polyether polyols. These polyols have a number average molecular weight of about 600 to 5,000, preferably about 1,000 to 3,000.

The diisocyanates used herein include hexamethylene diisocyanate (HDI), tolylene diisocyanate (TDI), diphenylmethane diisocyanate (MDI), hydrogenated MDI ($H_{12}$MDI), IPDI, CHDI, and derivatives thereof.

The chain extender used herein is not critical and may be any of commonly used polyhydric alcohols and amines. Examples include 1,4-butylene glycol, 1,2-ethylene glycol, 1,3-propylene glycol, 1,6-hexylene glycol, 1,3-butylene glycol, dicyclohexylmethane diamine (hydrogenated MDA), and isophorone diamine (IPDA).

The intermediate layer according to the invention is formed mainly of the thermoplastic polyurethane elastomer, with which another thermoplastic resin may be blended if desired for enhancing the effect and benefits of the invention. Examples of the other thermoplastic resin which can be blended include polyamide elastomers, polyester elastomers, ionomer resins, styrene block elastomers, hydrogenated polybutadiene, ethylene-vinyl acetate (EVA) copolymers, polycarbonates, polyacrylates, and polyamides.

According to the invention, the intermediate layer is formed to a Shore D hardness of 20 to 80, preferably 20 to 50, more preferably 25 to 45, most preferably 32 to 38. With a Shore D hardness of less than 20, the ball would become less resilient or less durable. A Shore D hardness of more than 80 would adversely affect the feel of the ball when hit and the resilience.

The intermediate layer is preferably formed to a specific gravity of at least 1.1, more preferably 1.15 to 2.0, further preferably 1.2 to 1.5, most preferably 1.22 to 1.4. The specific gravity of the intermediate layer is preferably greater than that of the solid core. Desirably, the specific gravity of the intermediate layer is greater than that of the solid core by at least 0.05, especially 0.08 to 0.15. Then, the moment of inertia of the ball is maintained so large that the attenuation of spin rate of the ball during flight may be minimized. The spin rate acquired immediately after a club shot is retained or slightly attenuated until the ball falls and lands. The ball can maintain stable flight until the ball lands on the ground.

To form the intermediate layer to a specific gravity within the above-defined range, an inorganic filler, especially a filler having a specific gravity of at least 3 may be blended in the polyurethane elastomer. Exemplary inorganic fillers are metal powder, metal oxides, metal nitrides, and metal carbides. Illustrative examples include tungsten (black, specific gravity 19.3), tungsten carbide (blackish brown, specific gravity 15.8), molybdenum (gray, specific gravity 10.2), lead (gray, specific gravity 11.3), lead oxide (dark gray, specific gravity 9.3), nickel (silvery gray, specific gravity 8.9), copper (reddish brown, specific gravity 8.9), and mixtures thereof. It is preferred to use such high specific gravity fillers although fillers having a relatively low specific gravity such as barium sulfate, titanium dioxide, and zinc white may also be used.

The gage or thickness of the intermediate layer may be determined as appropriate although it is preferably 0.2 to 3 mm, more preferably 0.5 to 2.5 mm thick.

Around the intermediate layer, the cover is formed to complete the golf ball of the invention. The cover may be formed mainly of an ionomer resin which is commonly used in conventional solid golf balls. Exemplary cover stocks which can be used herein include Himilan 1605 and 1706 by Du Pont-Mitsui Polychemicals Co., Ltd. and Surlyn 8120 and 8320 by E. I. duPont. A combination of two or more ionomer resins may also be used. If desired, the ionomer resin may be blended with well-known additives such as pigments, dispersants, antioxidants, UV-absorbers, UV-stabilizers, and plasticizers.

Although the hardness of the cover is not critical, this cover preferably has a Shore D hardness of 40 to 70, preferably 45 to 68, more preferably 50 to 65. With a cover hardness of less than 40 in Shore D, the ball would become less resilient or more susceptible to spin. A Shore D hardness of more than 70 would adversely affect the durability of the ball and the feel upon putting.

The cover preferably has a gage of 0.5 to 4 mm, more preferably 1.0 to 3 mm, most preferably 1.5 to 2.2 mm. With a cover gage of less than 0.5 mm, the ball would be less durable and sometimes less resilient. A cover gage of more than 4 mm would adversely affect the feel. The cover preferably has a specific gravity of 0.93 to 1.35, more preferably 0.95 to 1.3.

According to the invention, an adhesive layer is placed between the cover and the intermediate layer. Any of the adhesives which can firmly join both the layers may be used. For example, epoxy resin adhesives, urethane resin adhesives, vinyl resin adhesives, and rubber adhesives are useful.

Before the adhesive is applied to the intermediate layer, the surface of the intermediate layer may be roughened by a conventional technique. The thickness of the adhesive layer may be selected as appropriate although it is usually about 5 to 300 $\mu$m, especially about 10 to 100 $\mu$m thick.

If desired, each of the intermediate layer and the cover is constructed of two or more layers, and in this embodiment, the plural layers may or may not be adhesively joined. It is also acceptable to join the solid core to the intermediate layer with an adhesive as described above.

Since the intermediate layer is formed of a composition based on the thermoplastic polyurethane elastomer, the composition can be molded over the solid core by compression molding or injection molding.

On the other hand, the cover is formed of a cover stock based on the ionomer resin. The method of enclosing the intermediate layer with the cover is not particularly limited. Most often, a pair of hemispherical cups are preformed from the cover stock, the intermediate layer is wrapped with the pair of cups, and molding is effected under heat and pressure. Alternatively, the cover stock is injection molded over the intermediate layer.

The golf ball of the invention is formed with a multiplicity of dimples in the cover surface. The geometrical arrangement of dimples may be octahedral, icosahedral or the like while the dimple pattern may be selected from square, hexagon, pentagon, and triangle patterns.

While the above construction is met, the solid golf ball of the invention may be formed to have a diameter of not less than 42.67 mm and a weight of not greater than 45.93 g in accordance with the Rules of Golf.

The multilayer structure solid golf ball of the invention has improved rebound and spin properties.

EXAMPLE

Examples of the invention are given below by way of illustration and not by way of limitation.

Examples 1–4 & Comparative Examples 1–2

A solid core was prepared by kneading the ingredients shown in Table 1 and pressure molding the resulting compound in a conventional manner. A urethane elastomer Pandex T7890 (Dai-Nippon Ink & Chemicals K.K.) was injection molded around the core to form an intermediate layer. The intermediate layer was mechanically roughened on its surface. An adhesive of the type shown in Table 2 was applied thereto by a dispersion coating method. After the adhesive was dried, an ionomer resin mixture consisting of Himilan 1706 and Himilan 1605 in a weight ratio of 1/1 was injection molded around the intermediate layer. In this way, three-piece golf balls of the structure shown in FIG. 1. were prepared which had the parameters shown in Table 2.

For comparison purposes, three-piece golf balls were similarly prepared except that no adhesive was applied.

The golf balls were examined for flight performance and durability by the following tests.

Flight Performance

Using a swing robot of True Temper Co., the ball was hit with a driver (W#1) at a head speed of 45 m/sec to measure a carry and total distance.

Using the same swing robot, the ball was hit with No. 9 iron (I#9) at a head speed of 36 m/sec. A spin rate was measured by means of Science Eye (Bridgestone Sport Co., Ltd.).

Durability

Using the same swing robot, the ball was hit 300 times with a driver at a head speed of 38 m/sec. The number of shots at which the ball failed was recorded.

TABLE 1

| | Composition (pbw) | | | | | |
|---|---|---|---|---|---|---|
| | E1 | E2 | E3 | E4 | CE1 | CE2 |
| Solid core | | | | | | |
| 1,4-high-cis-polybutadiene | 100 | 100 | 100 | 100 | 100 | 100 |
| Zinc diacrylate | 30.5 | 33 | 30.5 | 30.5 | 30.5 | 33 |
| Zinc oxide | 5 | 5 | 5 | 5 | 5 | 5 |
| Barium sulfate | 9 | 7.9 | 9 | 9 | 9 | 7.9 |
| Antioxidant | 0.2 | 0.2 | 0.2 | 0.2 | 0.2 | 0.2 |
| Zinc salt of pentachlorothiophenol | 1 | 1 | 1 | 1 | 1 | 1 |
| Dicumyl peroxide | 0.8 | 0.8 | 0.8 | 0.8 | 0.8 | 0.8 |
| Intermediate layer | | | | | | |
| Urethane elastomer[1)] | yes | yes | yes | yes | yes | yes |
| Cover | | | | | | |
| Himilan 1706[2)] | 50 | 50 | 50 | 50 | 50 | 50 |
| Himilan 1605[2)] | 50 | 50 | 50 | 50 | 50 | 50 |

[1)]Pandex T7890 by Dai-Nippon Ink & Chemicals K.K.
[2)]Himilan 1706 is an ionomer resin in the form of an ethylene-methacrylic acid copolymer having an acid content of about 15% by weight, ion species Zn, and an ionization degree of about 60 mol % by Du Pont-Mitsui Polychemicals Co., Ltd.
Himilan 1605 is an ionomer resin in the form of an ethylene methacrylic acid copolymer having an acid content of about 15% by weight, ion species Na, and an ionization degree of about 30 mol % by Du Pont-Mitsui Polychemicals Co., Ltd.

TABLE 2

| | E1 | E2 | E3 | E4 | CE1 | CE2 |
|---|---|---|---|---|---|---|
| Solid core | | | | | | |
| Outer diameter (mm) | 36.5 | 36.5 | 36.5 | 36.5 | 36.5 | 36.5 |
| Specific gravity | 1.13 | 1.13 | 1.13 | 1.13 | 1.13 | 1.13 |
| Weight (g) | 28.9 | 29.0 | 28.9 | 28.9 | 28.9 | 29.0 |
| Hardness[3)] (mm) | 3.8 | 3.1 | 3.8 | 3.8 | 3.8 | 3.1 |

TABLE 2-continued

| | E1 | E2 | E3 | E4 | CE1 | CE2 |
|---|---|---|---|---|---|---|
| Initial velocity (m/s) | 78.3 | 78.7 | 78.3 | 78.3 | 78.3 | 78.7 |
| Intermediate layer | | | | | | |
| Outer diameter (mm) | 39.7 | 39.7 | 39.7 | 39.7 | 39.7 | 39.7 |
| Gage (mm) | 1.6 | 1.6 | 1.6 | 1.6 | 1.6 | 1.6 |
| Weight of intermediate layer + core (g) | 37.9 | 37.9 | 37.9 | 37.9 | 37.9 | 37.9 |
| Hardness[3)] (mm) | 3.7 | 3.0 | 3.7 | 3.7 | 3.7 | 3.0 |
| Initial velocity (m/s) | 76.6 | 77.0 | 76.6 | 76.6 | 76.6 | 77.0 |
| Adhesive layer | | | | | | |
| Urethane resin adhesive[4)] | ○ | ○ | | | | |
| Vinyl resin adhesive[5)] | | | ○ | | | |
| Rubber adhesive[6)] | | | | ○ | | |
| Thickness (μm) | 50 | 50 | 50 | 50 | | |
| Cover | | | | | | |
| Gage (mm) | 1.6 | 1.6 | 1.6 | 1.6 | 1.6 | 1.6 |
| Hardness (Shore D) | 62 | 62 | 62 | 62 | 62 | 62 |
| Golf ball | | | | | | |
| Outer diameter (mm) | 42.8 | 42.8 | 42.8 | 42.8 | 42.8 | 42.8 |
| Hardness[3)] (mm) | 3.0 | 2.5 | 3.0 | 3.0 | 3.0 | 2.5 |
| Weight (g) | 45.2 | 45.2 | 45.2 | 45.2 | 45.2 | 45.2 |
| Initial velocity (m/s) | 77.0 | 77.4 | 77.0 | 77.0 | 76.4 | 76.8 |
| Durability against 300 shots | no failure | no failure | no failure | no failure | failed at 50 | failed at 50 |
| W #1/HS45 | | | | | | |
| Spin (rpm) | 2548 | 2734 | 2540 | 2550 | 2550 | 2720 |
| Carry (m) | 207.9 | 208.1 | 208.0 | 207.9 | 205.2 | 206.2 |
| Total (m) | 221.0 | 222.0 | 221.0 | 221.0 | 218.5 | 216.7 |
| I #9/HS36 | | | | | | |
| Spin (rpm) | 8335 | 9220 | 8340 | 8338 | 7502 | 8298 |

[3)]a deflection under a load of 100 kg. It is noted that the hardness of the intermediate layer is expressed by a deflection of a sphere consisting of the solid core and the intermediate layer.
[4)]Rezamine D6028/Rezamine D52CLA/pure water = 100/50/50 by Dainichi Seika K.K.
[5)]251 by Sunstar K.K.
[6)]G17 by Konishi Bond K.K.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A multilayer structure solid golf ball comprising;

a solid core, an intermediate layer on the core formed mainly of a thermoplastic polyurethane elastomer, a cover on the intermediate layer formed mainly of an ionomer resin, and an adhesive layer between said intermediate layer and said cover, wherein said intermediate layer has a roughened external surface, and said adhesive layer is comprised of an epoxy resin adhesive, urethane resin adhesive, vinyl resin adhesive or rubber adhesive.

2. The golf ball of claim 1 wherein the intermediate layer has a specific gravity of at least 1.1.

3. The golf ball of claim 1, wherein said core has a distortion of 1 to 10 mm under a load of 100 kg and a Shore D hardness in the range of 30 to 60.

4. The golf ball of claim 1, wherein said core has a specific gravity in the range of 0.98 to 1.3.

5. The golf ball of claim 1, wherein said intermediate layer is formed from a thermoplastic polyurethane elastomer.

6. The golf ball of claim 1, wherein said intermediate layer has a Shore D hardness in the range of 20 to 80.

7. The golf ball of claim 1, wherein said intermediate layer has a specific gravity greater than that of said solid core by at least 0.05.

8. The golf ball of claim 1, wherein said intermediate layer has a gage in the range of 0.2 to 3 mm.

9. The golf ball of claim 1, wherein said adhesive layer has a thickness in the range of 5 to 300 $\mu$m.

10. The golf ball of claim 1, wherein an adhesive of said adhesive layer is selected from the group consisting of epoxy resin adhesives, urethane resin adhesives, vinyl resin adhesives and rubber adhesives.

11. The golf ball of claim 1, wherein said cover has a specific gravity in the range of 0.93 to 1.35.

12. The golf ball of claim 1, wherein said cover has a thickness in the range of 0.5 to 4 mm.

13. The golf ball of claim 1, wherein said cover has a Shore D hardness in the range of 40 to 70.

14. The golf ball of claim 1, wherein said cover is formed from a cover stockbased on an ionomer resin.

* * * * *